United States Patent [19]

Sherburn

[11] 4,120,550

[45] Oct. 17, 1978

[54] MULLION ADJUSTING DEVICE

[75] Inventor: Raymond Robert Sherburn, Montreal, Canada

[73] Assignee: Canadian General Electric Company, Limited, Toronto, Canada

[21] Appl. No.: 833,780

[22] Filed: Sep. 15, 1977

[51] Int. Cl.[2] ..... F25B 47/00; E06B 1/20

[52] U.S. Cl. ..... 312/296; 49/505; 52/214; 312/214

[58] Field of Search ..... 49/366, 478, 490, 504, 49/505; 312/296, 236; 52/212, 214, 217

[56] References Cited

U.S. PATENT DOCUMENTS

| | | | |
|---|---|---|---|
| 3,354,585 | 11/1967 | Jerchower | 49/504 |
| 3,788,019 | 1/1974 | Kiselewski | 49/505 |
| 3,835,660 | 9/1974 | Franck | 312/296 |

*Primary Examiner*—Casmir A. Nunberg

*Attorney, Agent, or Firm*—Frederick P. Weidner

[57] ABSTRACT

In a domestic two door side by side refrigerator, means for adjusting the curvature of the mullion cover so as to provide thereon a good sealing surface of the doors. The means comprises a spring which biases the mullion cover in a first direction, and a screw element acting upon the mullion cover in opposition to the spring bias.

11 Claims, 2 Drawing Figures

MULLION ADJUSTING DEVICE

In multicompartmented domestic refrigerating appliances wherein a divider wall is common to the compartments, the forward facing edge of the divider wall is covered by a channel member known generally as the mullion cover. The mullion cover is normally of steel to provide a magnetically attractive surface upon which the separate doors of the compartments can seal. The mullion cover is generally firmly affixed at the extremities thereof to the outer wall structure of the refrigerator; it connects to the divider wall structure along its length through thermal breaker strips which provide no support, and which are in fact normally supported by the mullion cover and the divider wall. Since the unsupported length of the mullion cover may be about 1.8 m. in large capacity eg. 500-600 l. (ca 20 cuft.) appliances of the "side by side" type, it is often found that the mullion cover deforms in the plane of the divider wall making it difficult to provide a seal thereon.

It is a primary object of my invention to provide in a refrigerating appliance of the above type a simple structure wherein the curvature of mullion cover may be adjusted.

In one aspect of my invention this objective achieved by providing in an aforesaid appliance a spring means which acts upon the mullion cover so as to bias the cover in a first direction, and a variable length element which is actuatable so as to bias the mullion cover in opposition to the spring means.

In a further and preferred aspect of my invention, the variable length element comprises a fixed length portion which may suitably be a U shaped bracket, the legs of which are secured to the divider wall with the bight situated rearwardly of the mullion cover and spaced therefrom. The variable length element further comprises a variable length portion which passes through the mullion and which is received in the bight of the bracket. A U shaped leaf spring having the bight thereof bearing upon the bight of the bracket but transversely thereto has distal portions which bear upon the inner surface of the mullion cover to provide said spring bias force.

Figure 1:
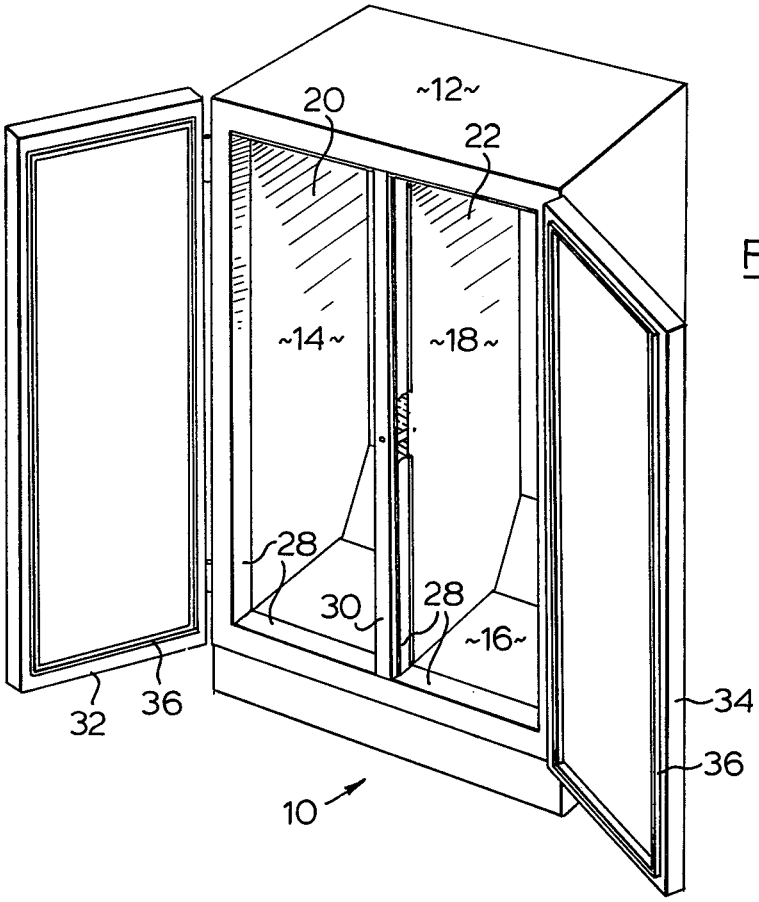

The scope of my invention will be more clear from the following description of a preferred embodiment thereof which is illustrated in the accompanying drawings wherein FIG. 1 is a perspective view of a two door side by side refrigerating appliance wherein the structure is partially broken away in the region of the adjustable means comprising my invention.

Figure 2:
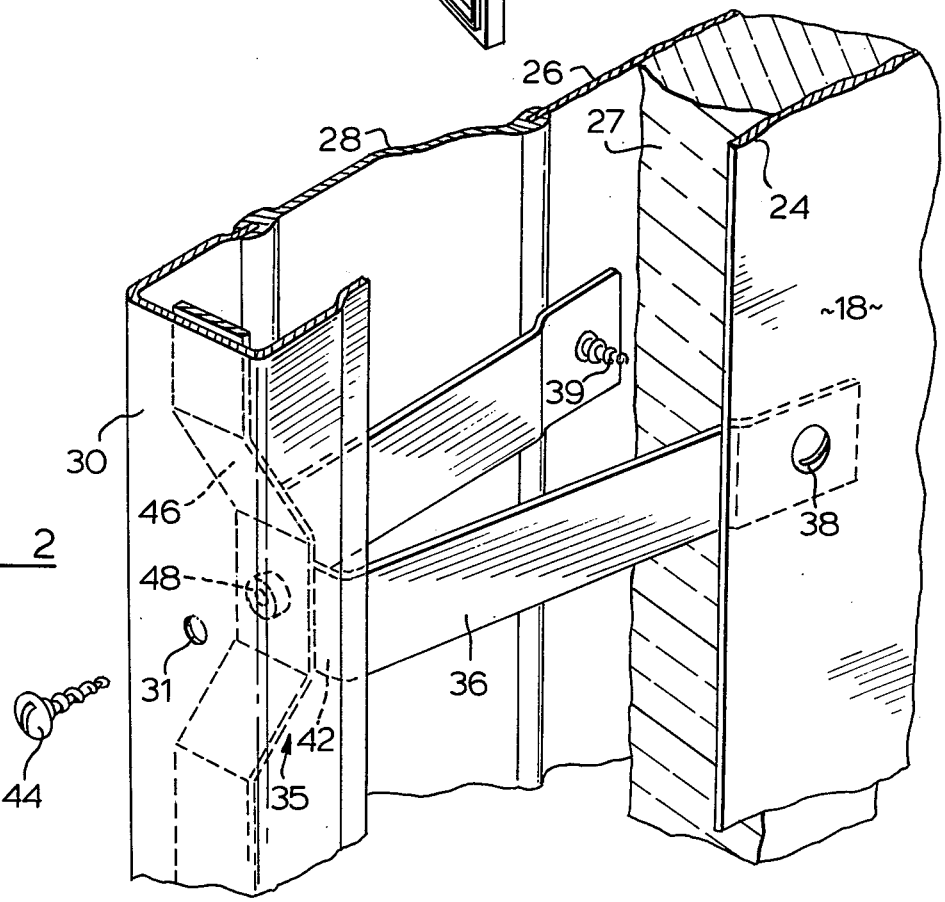

FIG. 2 is a view on an enlarged scale of the broken away portion of FIG. 1.

Referring to the figures in detail, a side by side domestic refrigerating appliance which is indicated generally by the numeral 10 comprises a fixed wall structure including an outer encasement 12, generally folded from sheet steel, and an inner wall structure 14, 16, 18 which defines a pair of open fronted compartments 20 and 22. Inner wall 18 is a dividing panel common to each compartment. Inner walls 14 and 16 are desirably folded from sheet metal and spaced from encasement 12, the spacing therebetween being filled with a thermally insulating material such as fiber glass or a foamed plastic composition. Panel 18 is formed from a pair of spaced apart sheet wall members 24, 26, having an insulating material 27 therebetween. The outward facing edge of panel 18 is covered by a mullion cover 30, normally formed from sheet steel. Mullion cover 30 is generally rigidly fixed by means such as welding, brazing or rivetting at the upper and lower extremities thereof to encasement 12. In order to reduce thermal leakage into the appliance, and also between compartments 20 and 22, no metal to metal contact is made between inner metal walls 14, 16 and 18 and the outer metal walls comprising encasement structure 12 and mullion cover 30. The edges of the sheet metal forming these members are spaced apart and spanned with breaker strips 28 constructed from a material having a low thermal conductivity such as polystyrene or other thermoplastic material. As best seen in FIG. 2, the breaker strips 28 have bifurcated ends which overlap the edges of the mullion cover 30 and the adjacent edges of walls 24 and 26 respectively. The breaker strips are thus supported on the wall structures, and they have little or no action in rigidifying mullion cover 30 so as to control its curvature. In refrigerating appliances wherein walls 24 and 26 are themselves constructed from a material having a low thermal conductivity each breaker strip 28 may be formed unipartitely with a respective wall. However, following normal practise the steel mullion cover 30 would still be joined to the inner wall structure by a joint which would not adequately support the mullion. Of course breaker strips having a design different to that illustrated are known, but in principal they are usually supported by the wall structure and mullion cover rather than vice versa.

Appliance 10 further comprises pair of doors 32, 34 which hinge adjacent opposite sides of the appliance. The doors are provided with magnetic gaskets 36 for example of a type shown in U.S. Pat. No. 2,659,118 issued Nov. 17, 1953 to Anderson et al. Such sealing means relies upon a close contact between the gasket and ferromagnetic portions of the encasement to promote a good and efficient door seal.

The structure so far described is wholly of a conventional nature, and it does not of itself form a part of my invention other than when in combination with an adjustable means for biasing the curvature of the mullion cover. The preferred means, which is illustrated in FIG. 2, comprises a variable length element 35 which functions so as to bias the mullion cover in a first direction, and a spring means 46 which counter-opposes the variable length means 35 so as to tend to bias the mullion cover 30 in the opposite direction. In this embodiment, element 35 comprises a fixed length portion consisting of a bracket 36 having the legs thereof secured by screw means 38 and 39 to the inner surfaces of walls 24 and 26 respectively, and a variable length portion consisting of a screw 44 which passes through an aperture 31 formed in mullion cover 30 to be threadably received in a plastic grommet 48 supported from the bight 42 of bracket 36. The purpose of grommet 48 is to reduce heat transference between the inner walls of appliance 10 and mullion cover 30. Actuation of screw 44 so as to shorten its effective length will cause the head of screw 44 to bear on the outwardly facing surface of the mullion cover, causing the latter to bow inwardly. Acting to generate a biasing force in opposition to screw 44 is the spring means 46, which comprises a broadly U shaped leaf compression spring. The legs of leaf spring 46 bear upon the inner surface of mullion cover 30, and the bight of the spring upon the bight of bracket 36, the two being generally transverse. The two bights may be separated by a pad having low thermal conductivity, but this is not considered necessary in the illustrated embodiment as the leaf spring 46 constitutes a moderately long and resistant thermal path.

It is to be remarked that leaf spring 46, because of its relatively wide area of contact with the inner surface of mullion cover 30, serves to correct any torsional deformation to which the mullion cover may be subjected.

It will be clear that actuation of screw 44 will cause the curvature of mullion cover to be varied either forwardly or rearwardly depending upon the effective length of variable length element 35, and that the curvature of the mullion cover may be adjusted so as to conform to that of door seals 36. The total desirable adjustment in passing from a maximum outwards curvature to maximum inwards curvature is found to be about 1 cm. when mullion cover 30 has a length of some 1.6 to 1.8 m. It will be apparent that other structures may be employed to provide the desired adjustment of mullion cover 30, and these are contemplated by my invention. Thus spring means 46 may be a tension spring so as to inwardly bias mullion cover 30. Variable length element 35 would then be provided with a surface portion bearing upon the inner surface of mullion cover 30. Such arrangement will permit the mullion cover to move forwardly against the bias of spring 46 under magnetic influence as doors 32, 34 are opened. This maybe overcome in a simple manner, for example by providing a screw means such as that illustrated and denoted by the numeral 44 with a collar securing to the shank thereof after the screw is inserted through aperture 31. It will be appreciated that this arrangement is somewhat more complex than that illustrated, for spring means 46 must attach to mullion cover and the fixed wall structure of the appliance. Compression spring arrangements such as that illustrated are to be preferred. The scope of my invention is not limited by these specifically described embodiments, however, but by the embodiments thereof defined in the claims appended hereto.

The embodiments of the invention in which an exclusive property or privilege is claimed are defined as follows:

1. In a domestic refrigerating appliance having at least two separate compartments and at least two doors sealing said compartments, said compartments being separated by a divider panel having a mullion cover upon which said doors seal, The improvement wherein said mullion cover is interconnected intermediate the ends thereof to the wall structure defining said compartments by (a) spring means acting to bias said mullion cover in a first direction in the plane of said divider panel (b) a variable length element actuatable to bias said mullion cover in opposition to said spring means, whereby the curvature of said cover may be adjusted.

2. The appliance defined in claim 1 wherein said spring means is a compression spring.

3. The appliance defined in claim 1 wherein said variable length element comprises a screw, the head of which bears upon said mullion cover.

4. The appliance defined in claim 1 wherein said variable length element includes a fixed length portion and a variable length portion.

5. The appliance defined in claim 4 wherein said fixed length portion is a U shaped bracket, the leg portions thereof attaching respectively to the walls of said divider panel, the bight portion thereof situated rearwardly of said mullion cover and spaced therefrom.

6. The appliance defined in claim 5 where said spring means is a U shaped leaf compression spring, the legs thereof bearing upon the rear surface of said mullion cover, the bight thereof bearing upon the bight of said bracket and being transverse thereto.

7. The appliance defined in claim 6 wherein said variable length element is a screw means threadably received in the bight of said bracket member.

8. The appliance defined in claim 7 wherein a plastic grommet locates in the bight of said bracket member and wherein said screw means is threadably received in said grommet.

9. The appliance defined in claim 8 wherein said grommet supports said leaf spring.

10. The appliance defined in claim 1 wherein said compartments are in side by side relationship.

11. The appliance defined in claim 6, wherein said compartments are in side by side relationship.

* * * * *